United States Patent [19]

Vézole

[11] 4,386,757

[45] Jun. 7, 1983

[54] MARINE PLATFORM LIFTING DEVICE

[75] Inventor: Lucien Vézole, Draveil, France

[73] Assignee: Societe des Engrenages Durand, Fourchambault, France

[21] Appl. No.: 244,131

[22] PCT Filed: Dec. 5, 1979

[86] PCT No.: PCT/FR79/00122

§ 371 Date: Aug. 5, 1980

§ 102(e) Date: Aug. 5, 1980

[87] PCT Pub. No.: WO80/01181

PCT Pub. Date: Jun. 12, 1980

[30] Foreign Application Priority Data

Dec. 6, 1978 [FR] France ..... 78 34358

[51] Int. Cl.[3] ..... B66F 7/12

[52] U.S. Cl. ..... 254/89 R; 254/95

[58] Field of Search ..... 254/95, 96, 97, 89 R, 254/105, 106, 108; 405/202, 196–199

[56] References Cited

U.S. PATENT DOCUMENTS

| | | | |
|---|---|---|---|
| Re. 29,539 | 2/1978 | Willke . | |
| 2,944,403 | 7/1960 | Smith . | |
| 3,565,400 | 2/1971 | Yamura | 254/106 |
| 3,743,247 | 7/1973 | Willke et al. | 254/95 |
| 3,936,032 | 2/1976 | Waschulzik et al. | 254/108 |
| 4,203,576 | 5/1980 | Sutton | 254/95 |

FOREIGN PATENT DOCUMENTS

| | | |
|---|---|---|
| 1307277 | 10/1962 | France . |
| 1579531 | 8/1969 | France . |
| 2143189 | 2/1973 | France . |
| 7606165 | 12/1977 | Netherlands . |
| 590975 | 1/1975 | Switzerland . |
| 1251571 | 10/1971 | United Kingdom . |

*Primary Examiner*—Robert C. Watson

*Attorney, Agent, or Firm*—Pollock, Vande Sande & Priddy

[57] ABSTRACT

A device for controlling the relative vertical movements between the bridge and the feet of a marine platform, including racks cut in uprights fixed to the feet, and locomotor units each comprising a frame equipped with pinions driven in rotation by motors and meshing with the racks. Each locomotor unit frame is attached by an articulation to a connecting rod which extends along the upright, and by a separate articulation to the bridge, and is associated with a mechanism for balancing the overturning torque set up by the force which the connecting rod transmits. The device is intended for a platform for the drilling of oil wells.

9 Claims, 10 Drawing Figures

MARINE PLATFORM LIFTING DEVICE

The present invention refers to a lifting device which produces vertical relative movements between the bridge and the bearer feet of a movable marine platform.

The device in accordance with the invention is fitted to a marine platform intended for work at sea, such as the drilling of oilwells.

A marine platform is composed of a horizontal bridge and at least three vertical feet. They bear against the bottom of the sea so as to support the bridge. The platform may be brought by floating over a predetermined site, with the feet in raised position. The feet are then lowered into the water until their soles bear against the sea bottom. The bridge of the platform is then lifted above the level of the water by bearing against the feet. The bridge and the feet of the platform are guided relative to one another by means of guide shoes. This guidance helps to assure the stability of the platform on its feet, and is the more effective the greater the distance between the lower and upper guide shoes. A relatively large clearance is provided between each foot and the associated guide shoes in order to allow normal operation and economical production.

The lifting devices which are fitted to marine platforms for assuring the relative movements between the bridge and the feet are of various kinds. Certain lifting devices are of the rack-and-pinion type. For example, the U.S. Pat. Nos. 3,183,676 and 2,924,077 describe devices of this kind. Each of these devices comprises racks which are integral with the feet and mesh with driving pinions. These driving pinions are mounted on frames which are integral with the bridge. Hence the guidance of each foot must be achieved accurately by employing guide members mounted above the pinions upon a superstructure integral with the bridge. These guide members must be separated from the guide members located at the level of the bridge by a relatively large distance. The feet and the racks may also undergo large deformations between the guide assemblies. Under these conditions the teeth of the pinions and the racks no longer mesh correctly.

The object of the present invention is a lifting device of the rack-and-pinion type in which the teeth mesh correctly even if the racks undergo deformations. The device presents the advantage of being isostatic. It enables the omission, above the driving pinions, of guide shoes connected to the bridge of the platform. It allows oscillation of the feet while avoiding overloads upon the pinions at the time of the retention of the platform in working position.

The device in accordance with the invention is fitted to a platform comprising a bridge supported by feet, and it includes, on the one hand, racks cut in uprights fixed to the feet, and, on the other hand, locomotor units each comprising a frame equipped with pinions driven in rotation by motors and meshing with the said racks, the bridge being suspended at each locomotor unit by a suspension system comprising an articulation for connection to the locomotor unit, and it is essentially characterized by the fact that the articulation to the locomotor unit is located substantially in the vertical plane of symmetry of the upright containing the longitudinal axis of the foot, and that each frame of the locomotor unit is connected to at least one other locomotor unit frame by at least three horizontal tie rods located on opposite sides of the said plane of symmetry.

The invention will now be described in greater detail by referring to several embodiments described by way of example and illustrated by the attached drawings.

Figure 1:
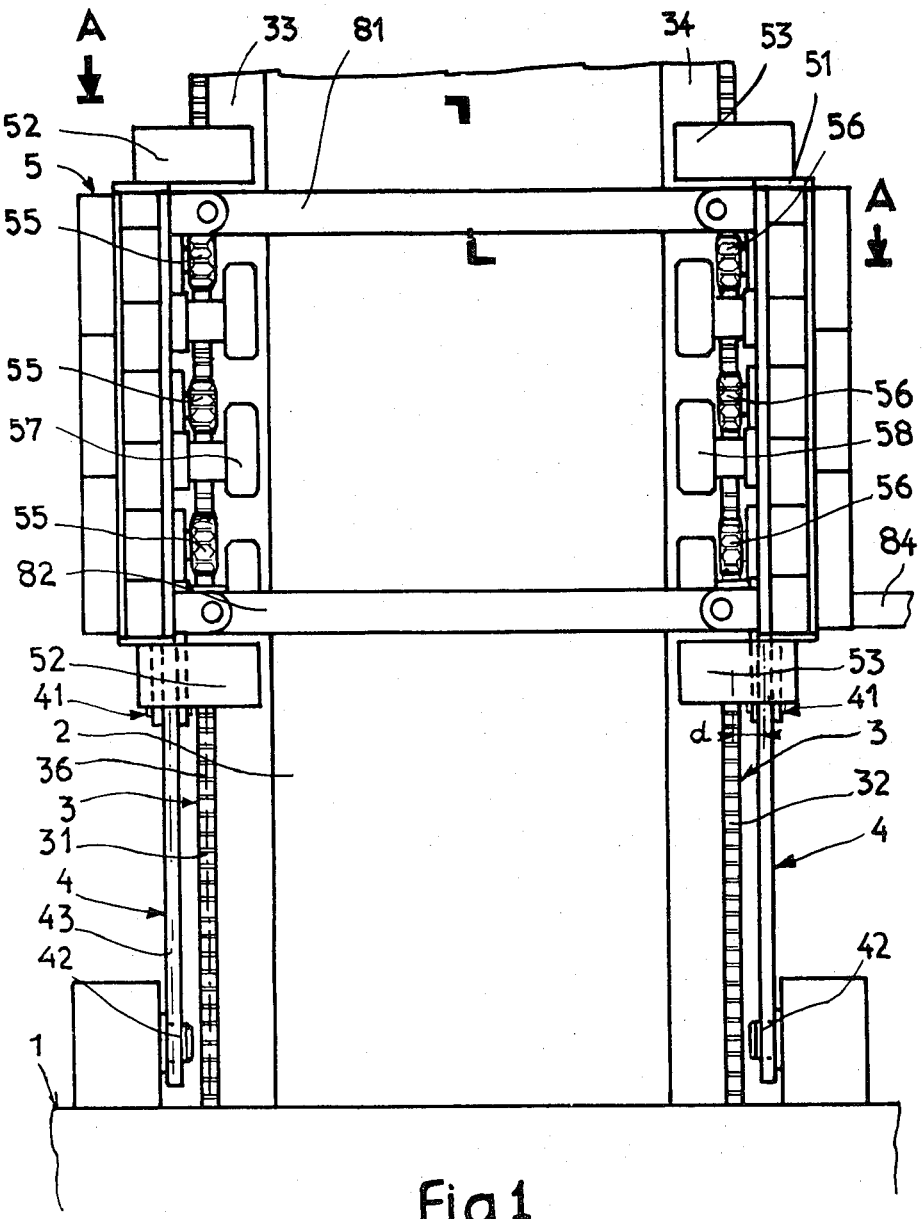
FIG. 1 is a front view of one embodiment of the lifting device comprising two locomotor units associated with one foot of the platform.
Figure 3:
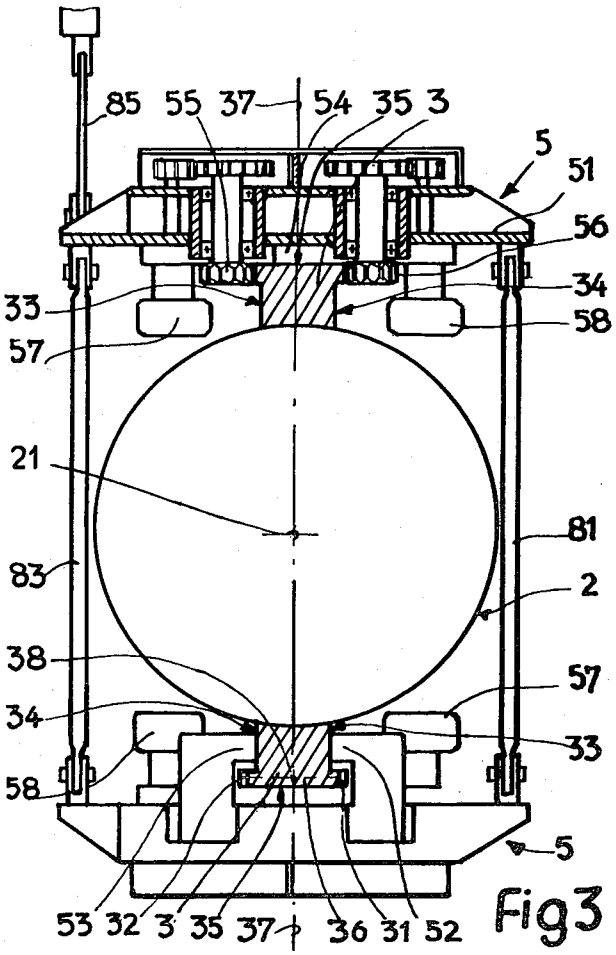
FIG. 3 is a plan view in section along the line A—A in FIG. 1.
Figure 2:
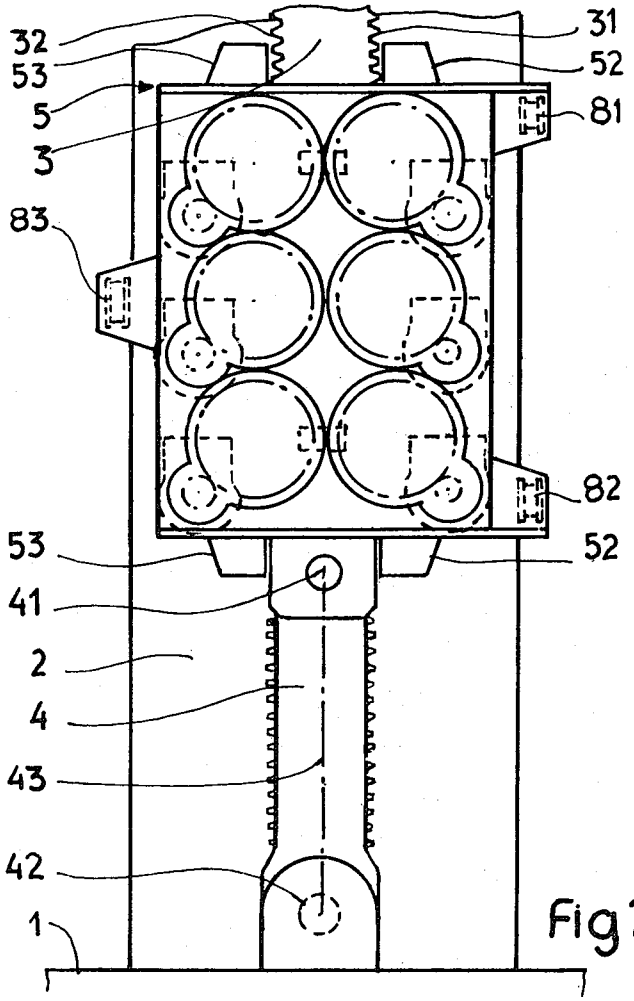
FIG. 2 is a view from the left of FIG. 1.

With reference to FIGS. 1 to 10, the platform includes a horizontal bridge 1 which forms a floatable tank. This bridge is supported by at least three feet 2. The feet represented in the drawings have a cylindrical section but a polygonal shape may also be suitable. These feet are constructed from tubes but can also be constructed in a different way. Each foot passes through an opening in the bridge of the platform, where it is guided by a set of shoes.

Uprights 3 are fixed onto each foot 2 in parallel with its axis. Two racks 31 and 32 having straight teeth are formed in each upright 3. The planes which envelop the tips and feet of the teeth forming these two racks are parallel, the teeth in turn being parallel. These racks are symmetrical with respect to the plane of symmetry 37 of the upright and are opposed towards the outside.

The plane of symmetry 37 of the two racks 31 and 32 cut in each upright passes through the axis of symmetry 21 of the corresponding foot. Each upright is provided with two guide tracks 33 and 34 and one lateral guide track 35. The guide tracks 33 and 34 are plane and parallel with the teeth of the racks, and the lateral track 35 is plane and perpendicular to these same teeth. Hence each upright has the general shape of a T, the guide tracks 33 and 34 being located between the teeth of the racks and the periphery of the associated foot. The T-section of the uprights is suitable for the guidance defined above, but other sections may be used.

Each upright 3 provided with two racks cooperates with a locomotor unit generally identified by the reference 5. Each locomotor unit 5 has a frame 51. It is equipped with a set of pinions 55 meshing with the rack 31 of the associated upright and a set of pinions 56 meshing with the rack 32 of the same upright. The pinions 55 and 56 are mounted upon shafts guided in rotation in the frame 51. Because of the arrangement of the racks 31 and 32, the set of pinions 55 and the set of pinions 56 of each locomotor unit frame the associated upright 3.

The reactions between the pinions 55 and the teeth of the rack 31 are balanced by the reactions between the pinions 56 and the teeth of the rack 32. The equality of these reactions assures the centering of each locomotor unit with respect to the associated upright. The axes of the pinions 55 and 56 of one and the same locomotor unit are parallel with one another. The axes of the pinions 55 of one locomotor unit are contained in the plane of the axes of the pinions 56 of the opposite locomotor unit.

Each pinion 55 or 56 is coupled to a reduction gear driven by a motor 57 or 58, respectively.

Figure 4:
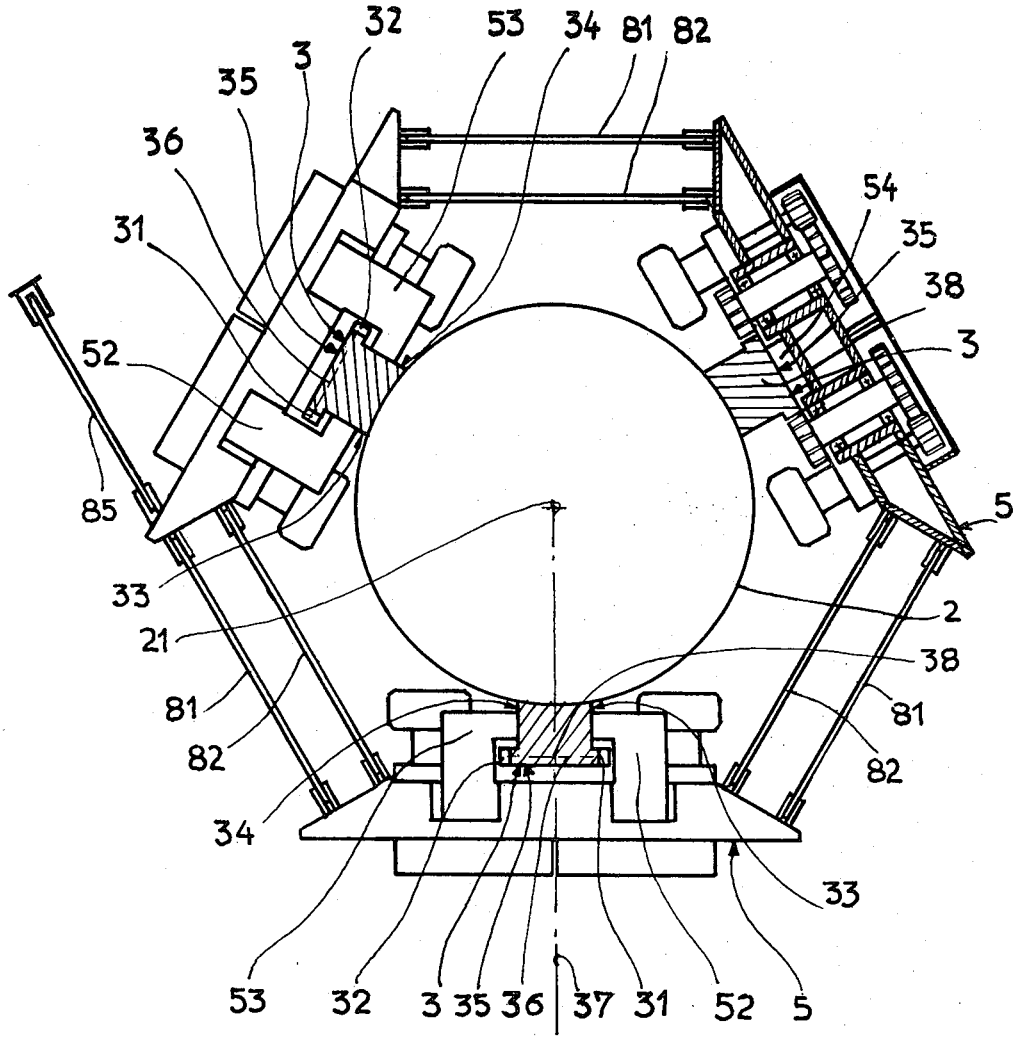
FIG. 4 is a plan view of a second embodiment of the lifting device comprising three locomotor units associated with one foot of the platform.

In the embodiments of FIGS. 1 to 3, 5 and 6, 7 and 8, and 10, each foot is integral with two uprights 3 associated each with one locomotor unit 5. The two associated uprights 3 are arranged at 180° from one another and are symmetrical with respect to the axis of symmetry of the foot. In the embodiments of FIG. 4 or FIG. 9, each foot is integral with three uprights 3 arranged at 120° with respect to one another about the axis of symmetry.

The relative guidance of the frame with respect to the plane of symmetry of the teeth is assured by the reactions from meshing. Each locomotor unit frame is associated with means which balance the considerable overturning torque which is generated by the force transmitted between the locomotor units and the bridge, and which compel it to follow the associated foot. Each locomotor unit frame is connected to at least one other locomotor unit frame by at least three horizontal tie rods located on opposite sides of the plane of symmetry 37 of the upright, which passes through the longitudinal axis 21 of the foot.

In the embodiments of FIGS. 1 to 3,5 and 6,7 and 8, and 10, the two locomotor units opposed with respect to the axis of a foot are connected together by three horizontal tie rods 81,82,83, which assure the balancing of the overturning torques. The three tie rods which are coupled to each locomotor unit are parallel with the teeth of the racks and with the axes of the pinions 55 and 56. Each of the tie rods is connected by an articulation about a fixed axis on the frame of one locomotor unit and is connected by an articulation about a fixed axis on the frame of the opposite locomotor unit. At least one of the two articulations of each tie rod is an articulation with a ball joint. The tie rods connecting the two locomotor units are three in number, so that the system is isostatic. The tie rod 83 is arranged on one side of the foot and of the plane of symmetry 37, the tie rods 82 and 81 being arranged on the opposite side. The tie rod 83 could be replaced by two tie rods articulated each to one of the units and on the other hand to a balance bar having its axis articulated to the other locomotor unit. The center-distance between the articulations of the tie rod 81 is equal to the center-distance between the articulations of the tie rod 82 and to the center-distance between the articulations of the tie rod 83. The assembly formed by the two locomotor units connected by the tie rods 81 and 82 substantially forms a deformable parallelogram.

In the embodiment of FIG. 4 or FIG. 9, each locomotor unit is coupled to two locomotor units by four horizontal tie rods 81 and 82. Two tie rods 81, 82 extend on one side of the plane of symmetry 37 of the upright, while two other tie rods 81, 82 extend on the opposite side of this plane of symmetry. The locomotor units are connected in pairs by two horizontal tie rods, the lower one 82, the other, upper one 81. Each tie rod is coupled by two ball joint articulations to two locomotor units.

In each embodiment, one of the locomotor units is connected to the bridge by way of a coupling bar 85. This bar 85 is connected at one end to the frame of the locomotor unit by an articulation, and is connected at its other end to the bridge of the platform by an articulation. At least one of the articulations is a ball joint articulation. Preferably, this bar 85 is parallel with the tie rods 81 to 83. The articulation for coupling this bar onto the frame of a locomotor unit is remote from the plane of symmetry of the teeth on the upright.

Each locomotor unit is equipped with guide members 52 and 53 which frame the upright 3 and are capable of guiding its frame with respect to the plane of symmetry 37 of the teeth of racks. These guide members 52 the (there are at least two) cooperate with the guide track 33 which is parallel with the teeth of the rack and with the plane of symmetry 37. The guide members 53 (there are at least two) cooperate with the opposite guide track 34. The two guide members 52 associated with the track 33 are arranged one above the other and the two guide members 53 associated with the track 34 are likewise arranged one above the other.

Each locomotor unit includes at least one guide member 54 which cooperates with the lateral guide track 35 on the associated upright. This track is perpendicular to the plane 37 and to the teeth of the racks. Preferably, at least two guide members 54 mounted on the frame of a locomotor unit.

The guide members 52, 53, 54 consist, for example, of shoes or rollers.

The bridge is suspended at the locomotor units of one and the same foot by an articulated suspension system, connected to each locomotor unit by an articulation 41 or 44, which transmits the forces and comprises at least two suspension connecting rods 4 which directly or indirectly connect the locomotor units and the bridge.

The vertical line of force passing through the articulation 41 or 44 for connection of each locomotor unit to the articulated suspension system and through the plane of symmetry 37 is located at a greater distance with respect to the axis 21 of the foot than the line of force 38 from the rack (the line of the resultant of the vertical forces applied to the rack). Consequently an over-turning torque tends to make each locomotor unit pivot about an axis perpendicular to the plane of symmetry 37 of the upright, which passes through the longitudinal axis 21 of the foot. This torque depends upon the distance d between the articulation 41 or 44 and the line of force 38.

In the embodiments of FIGS. 1 to 4, the articulated suspension system includes two suspension connecting rods 4, each of which extends vertically beside an upright 3. The longitudinal axis of each connecting rod is located substantially in the plane of symmetry 37 of the two racks on this upright and passes through the connecting articulation 41. Each connecting rod is connected to the locomotor unit frame by way of the said articulation 41 which is of the ball joint type and comprises a pin engaged in a head integral with the frame. It is attached to the bridge by way of a ball joint articulation 42 composed of a pin connected to an anchor piece integral with the bridge. The longitudinal axis of symmetry 43 of the connecting rod which passes through the pins 41 and 42 is at a greater distance from the foot than the median plane 36 of the racks 31 and 32 (the plane perpendicular to the teeth of the racks and passing through their centers). Each locomotor unit is subjected to an overturning torque which depends upon the force transmitted and upon the distance d between the axis of symmetry of the connecting rod and the median plane defined above. The overturning torque tends to make the locomotor unit pivot about an axis parallel with the median plane 36.

In the embodiment of FIGS. 5 to 9, the articulated suspension system comprises at least one articulated ring 91 and 92. It is connected to the locomotor units 5 by the connecting articulations 41 or 44 each located in a plane of symmetry 37 of an upright. Each articulation ring 91,92 is connected to at least two vertical connecting rods which connect it in an articulated manner either to the locomotor units or to the bridge or to another ring.

Figure 5:
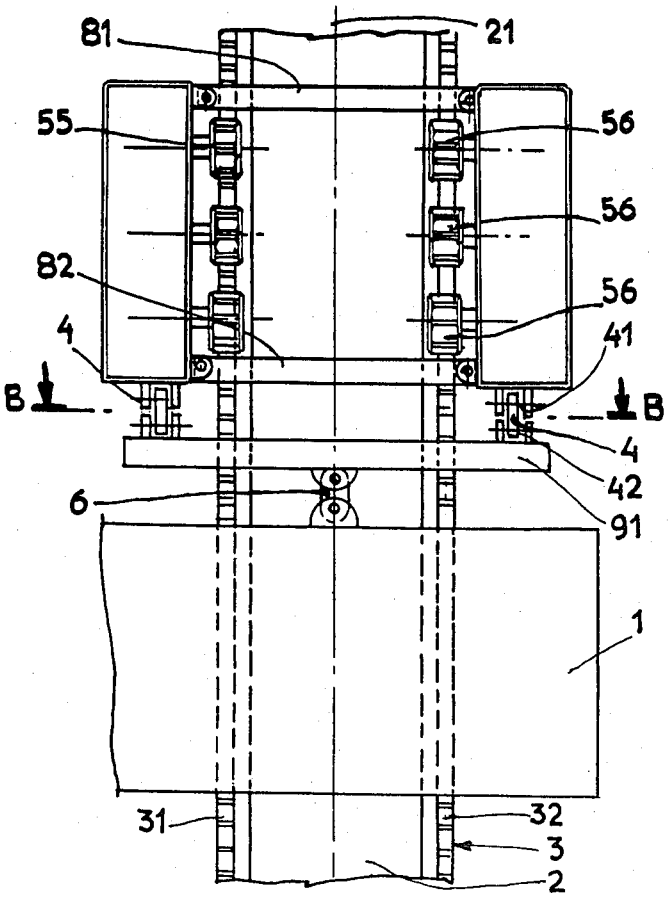
FIG. 5 is a front view of an embodiment improving upon that of FIG. 1.
Figure 6:
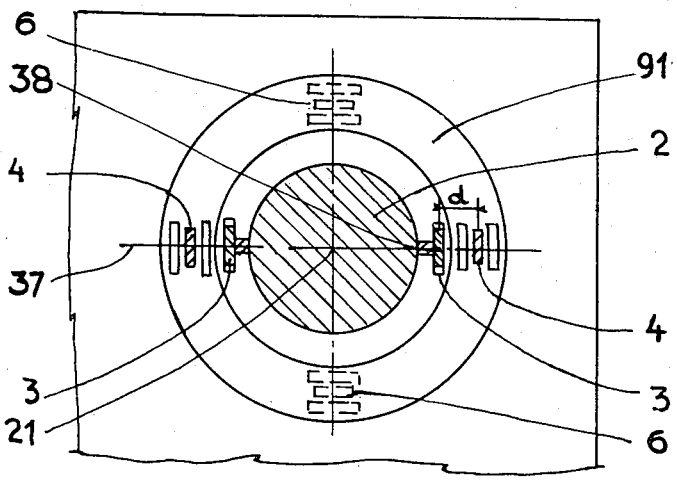
FIG. 6 is a section along B—B in FIG. 5.

In the embodiment of FIGS. 5 and 6, the suspension connecting rods 4 are articulated to a balancing frame or ring 91 which surrounds the foot 2. This ring is connected by two connecting rods 4 to the locomotor units and is in turn connected by two connecting rods 6 to the bridge. The articulations of the connecting rods 4 onto the ring 91 are diametrically opposed. The articulations of the connecting rods 4 and 6 onto the ring 91 are on diameters at right angles to each other.

Figure 7:
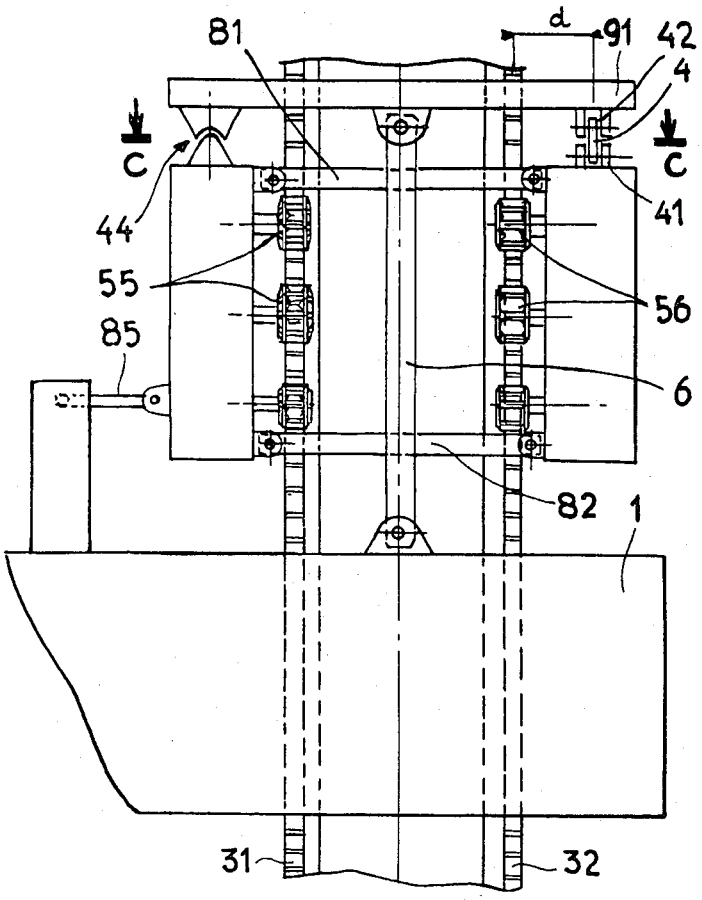
FIG. 7 is a variant of FIG. 5.
Figure 8:
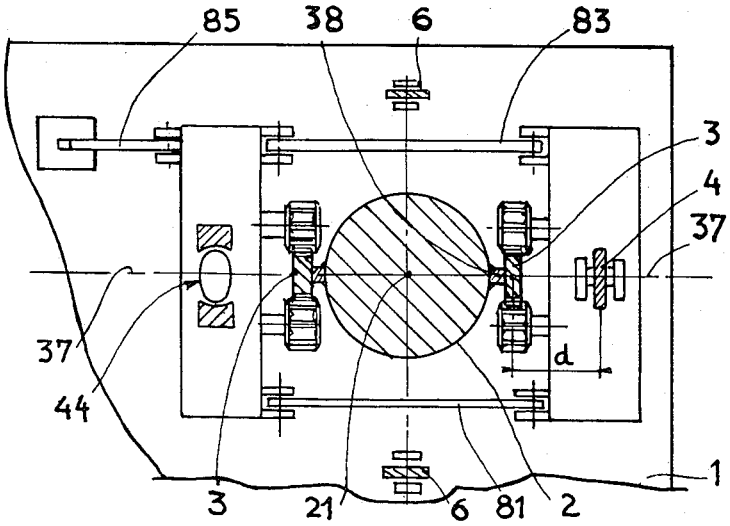
FIG. 8 is a section along C—C in FIG. 7.
Figure 9:
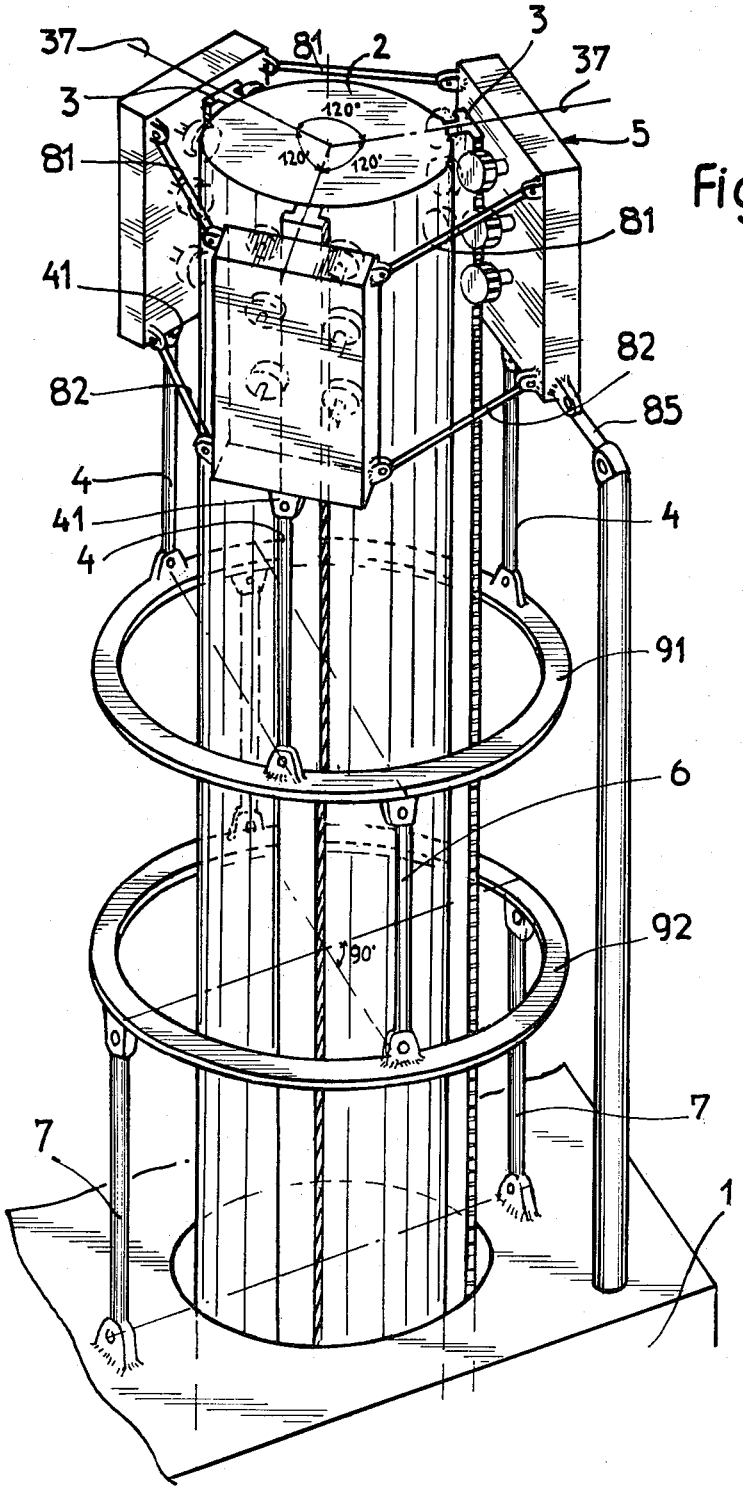
FIG. 9 is a view of an embodiment improving upon that of FIG. 4.

In the embodiment of FIGS. 7 and 8, the ring 91 is mounted above the locomotor units. It bears upon the locomotor units either by two ball-and-socket bearings 44 or by two suspension connecting rods 4 each articulated to a locomotor unit frame by the articulation 41 and to the ring 91. The bearings 44 or the connecting rods 4 are arranged symmetrically with respect to the axis of the foot in the planes of symmetry 37 of the uprights. Suspension connecting rods 6 are articulated to the ring 91 and to the bridge 1. They are arranged symmetrically with respect to the axis of the foot and orthogonally with respect to the bearings 44 or to the connecting rods 4.

In the embodiment of FIG. 9, the device includes three locomotor units round the foot and the articulated system of suspension comprises two rings 91 and 92. The ring 91 is connected to the three motor units by the suspension connecting rods 4, the connecting articulations 41 of which are located in the planes of symmetry 37. They are articulated onto the ring 91 and are arranged at 120° from one another. The ring 91 and the ring 92 are connected together by two connecting rods 6 which are symmetrical with respect to the axis 21 of the foot. The ring 92 is connected to the bridge by two articulated connecting rods 7. The articulations of the connecting rods 6 onto the ring 92 and the articulations of the connecting rods 7 onto this same ring are located upon two diameters at right angles to each other. The articulations of the connecting rods 6 onto the ring 91 are located upon a diameter which is parallel with the chord which joins the articulations of two of the connecting rods 4 onto this same ring 91.

Figure 10:
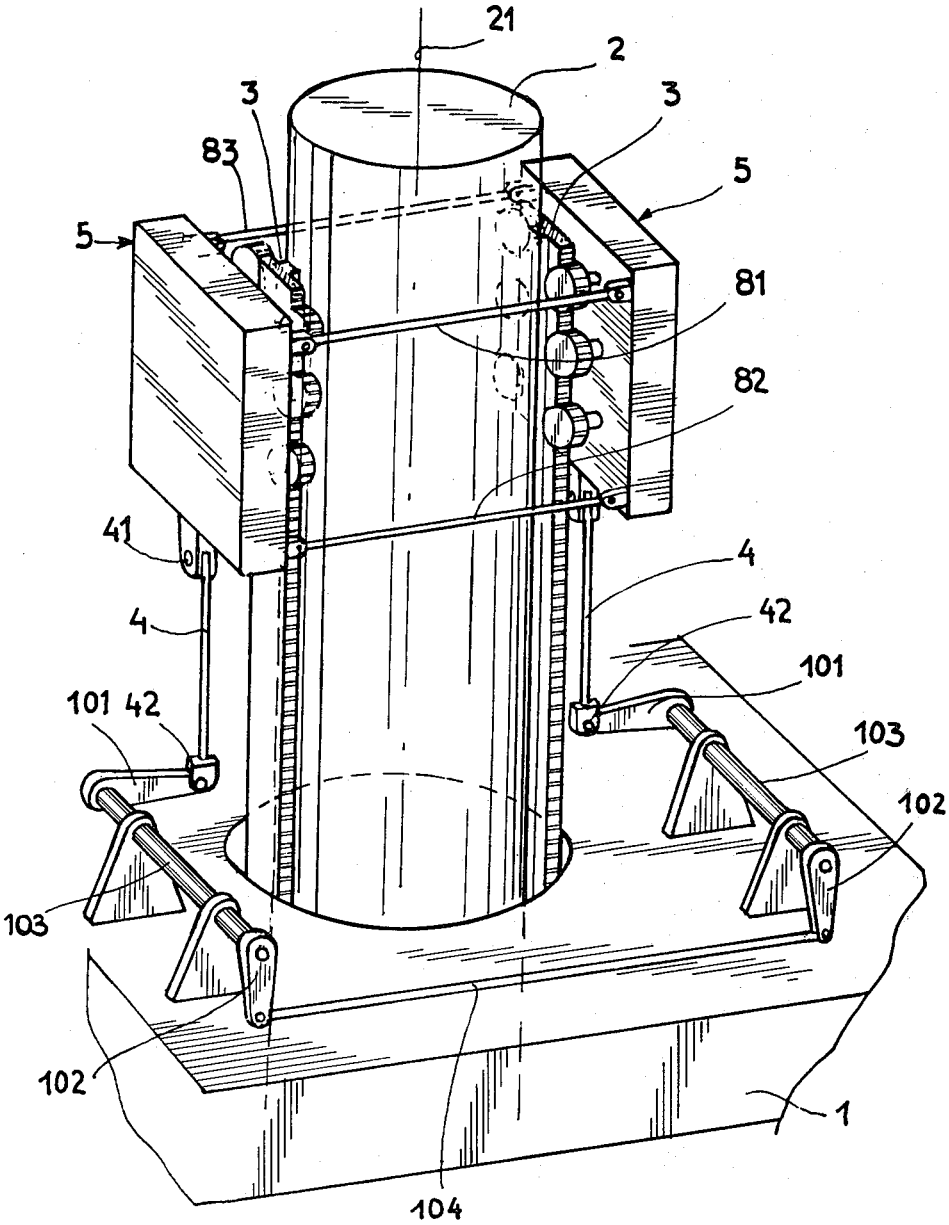
FIG. 10 is a view of an embodiment improving upon that of FIG. 1.

In the embodiment of FIG. 10, each of the suspension connecting rods 4 is coupled by a balljoint articulation to a right angle comprising crank 101 and a crank 102. The two cranks 101 and 102 are integral with a shaft 103 guided horizontally in bearings fixed to the bridge. The two shafts 103 are arranged in parallel at equal distances from the axis of the foot and from the connecting rods 4. The cranks 102 of the two right angles are parallel with one another. They are connected by a horizontal tie rod 104. This articulated system of rods comprising two right angles assures balancing of the forces between the two locomotor units.

The operation of the lifting device will now be explained.

The pinions 55 and 56 are driven in rotation simultaneously so as to move the frames 51 along the uprights 3. When the bridge is floating and the feet are raised, the connecting rods 4 are subjected to forces in one direction. As soon as the feet rest on the sea bottom and the platform is above the water the connecting rods 4 are subjected to forces in the opposite direction.

The overturning torques applied to the frames of the locomotor units associated with one foot introduce a force passing through the articulations 41 or 44. These torques are withstood by the tie rods 81, 82, 83. Thus, in the embodiment of FIGS. 1,2 and 3, when the bridge is raised with respect to the feet, the upper tie rod 81 is in tension and the lower tie rod 82 is in compression. Conversely, when the feet are raised with respect to the bridge, the upper tie rod 81 is in compression, the lower tie rod 82 being in tension.

Due to the articulations of the tie rods and of the coupling bar, each locomotor unit can follow the horizontal movements of the associated foot. The coupling bar 85 prevents the locomotor units from turning. The guide shoes 54 contribute to the centering of the pinions opposite the racks. The guide members 52 and 53 intervene in case the drive couplings of the driving pinions become unbalanced.

The articulated suspension mechanism comprising one or two rings allows the oscillations of the locomotor units which may follow the oscillations of the associated foot. This solution avoids an overload upon the pinions at the time of the retention of the platform in the fixed working position, which is assured by tightening the brakes or if necessary by locking.

The lifting device is applicable to feet the uprights of which each include only one rack, provided that the points of application of forces between the suspension system and the locomotor units are located in the planes of symmetry of the uprights.

I claim:

1. A lifting device for a marine platform comprising (a) a bridge supported by feet on which are fixed uprights each provided with two racks located symmetrically with respect to a plane;

(b) locomotor units each comprising a frame equipped with pinions rotatably driven by motors and meshing with said two racks;

(c) said bridge being suspended at each locomotor unit by a suspension system connected to each frame of a said locomotor unit by an articulation located substantially in said plane of symmetry of said racks and connected to said bridge by two suspension connecting rods each connected by an articulation to said bridge;

(d) each frame of said locomotor unit being connected to at least one other locomotor unit frame by at least three horizontal tie rods articulated each to two said frames and located on opposite sides of said plane of symmetry.

2. A lifting device according to claim 1, wherein said two suspension connecting rods are each connected by said articulation located substantially in the said plane of symmetry to said locomotor unit.

3. A lifting device according to claim 1, wherein said suspension system comprises at least one ring connected to said locomotor units by said articulations.

4. A lifting device as in claim 3, comprising rings connected together by two connecting rods, one of said rings being connected to said locomotor units, and the other of said rings being connected to said bridge.

5. A lifting device according to claim 1 or 2, comprising suspension connecting rods coupled by said articulations to said locomotor units and coupled to right-angles connected by a tie rod.

6. A lifting device according to claim 1 or 2, comprising a coupling bar articulated to one of said locomotor units and to said bridge.

7. A lifting device according to claim 1 or 2, wherein said tie rods for balancing said locomotor units are parallel with the axes of said pinions.

8. A lifting device according to claim 1 or 2, wherein each said locomotor unit comprises guide members which cooperate with guide tracks on said upright, said guide tracks being parallel with the teeth of said racks.

9. A lifting device according to claim 1 or 2, wherein each locomotor unit comprises at least one guide member cooperating with a guide track on said upright, said guide track being perpendicular to the teeth of said racks.

* * * * *